US005365025A

United States Patent [19]

Kraai et al.

[11] Patent Number: 5,365,025

[45] Date of Patent: Nov. 15, 1994

[54] LOW BACKPRESSURE STRAIGHT-THROUGH REACTIVE AND DISSIPATIVE MUFFLER

[75] Inventors: Leon A. Kraai, Jackson; Robert L. Sager, Jr., Grass Lake; William E. Hill, Ann Arbor, all of Mich.

[73] Assignee: Tennessee Gas Pipeline Company, Lincolnshire, Ill.

[21] Appl. No.: 110,332

[22] Filed: Aug. 20, 1993

Related U.S. Application Data

[63] Continuation of Ser. No. 825,536, Jan. 24, 1992, abandoned.

[51] Int. Cl.[5] ..... F01N 1/02

[52] U.S. Cl. ..... 181/249; 181/252; 181/258; 181/272

[58] Field of Search ..... 181/247, 248, 249, 252, 181/255, 256, 258, 264, 267, 269, 272, 282

[56] References Cited

U.S. PATENT DOCUMENTS

| | | | |
|---|---|---|---|
| 1,878,424 | 9/1932 | Oldberg | 181/250 |
| 1,949,074 | 2/1934 | Gunn | 181/248 |
| 1,975,861 | 10/1934 | Oldberg | 181/250 |
| 2,014,666 | 9/1935 | Peik | 181/256 |
| 2,099,858 | 11/1937 | Mackenzie et al. | 181/250 |
| 2,311,676 | 2/1943 | Maxim | 181/252 |
| 2,326,612 | 8/1943 | Bourne | 181/252 |
| 2,583,366 | 1/1952 | Engels | 181/252 |
| 2,937,707 | 5/1960 | Ernst | 181/252 |
| 3,754,619 | 8/1973 | McCormick | 181/248 |
| 3,981,378 | 9/1976 | Potter | 181/230 |
| 4,263,981 | 4/1981 | Weiss et al. | 181/252 |
| 4,371,053 | 2/1983 | Jones | 181/249 |
| 4,444,288 | 4/1984 | Sekiya et al. | 181/258 |
| 4,785,909 | 11/1988 | Young | 181/252 |
| 4,846,302 | 7/1989 | Hetherington | 181/272 X |

*Primary Examiner*—Khanh Dang

*Attorney, Agent, or Firm*—Harness, Dickey & Pierce

[57] ABSTRACT

A sound absorbing muffler used to attenuate noise carried by the exhaust gases of an internal combustion engine includes a straight-through flow tube of constant diameter and cross-section. The muffler utilizes both reactive and dissipative components and includes two annular sound absorbing end chambers, an outer annular resonating chamber, and an inner sound absorbing means. The muffler's configuration produces effective noise attenuation, yet low backpressure.

28 Claims, 2 Drawing Sheets

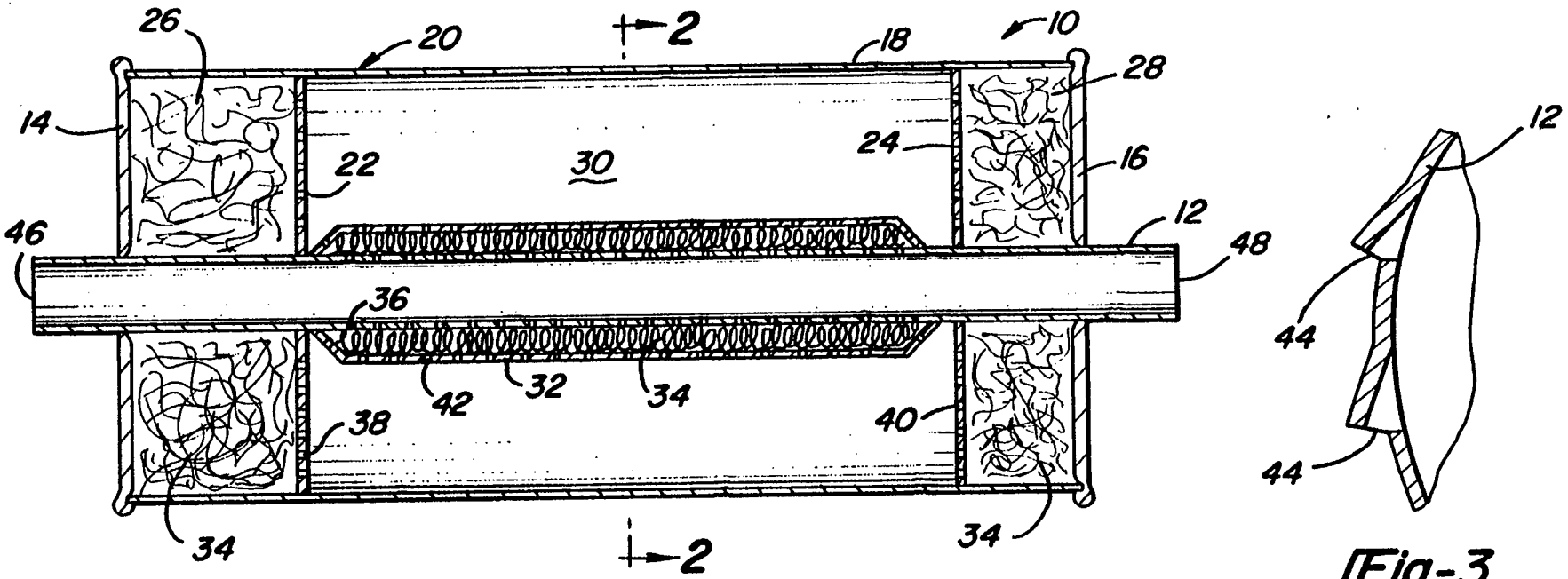
Fig-1
Fig-3
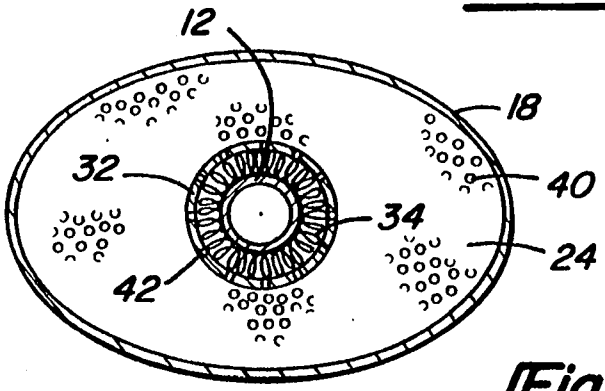
Fig-2
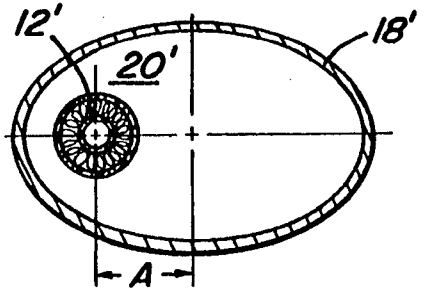
Fig-4

LOW BACKPRESSURE STRAIGHT-THROUGH REACTIVE AND DISSIPATIVE MUFFLER

This is a continuation of United States patent application Ser. No. 07/825,536, filed Jan. 24, 1992, entitled LOW BACKPRESSURE STRAIGHT-THROUGH REACTIVE AND DISSIPATIVE MUFFLER, now abandoned.

BACKGROUND OF THE INVENTION

This invention relates generally to an acoustic muffler, and more particularly to a muffler for use in conjunction with a motor vehicle internal combustion engine to reduce exhaust noise, although it also may be used in other applications of silencing a fluid flow.

A muffler is generally connected to the outlet of an internal combustion engine exhaust gas system to reduce exhaust noise from the engine. There are two general classifications of mufflers, reactive and dissipative. Reactive mufflers are usually composed of several chambers of different volumes and shapes connected together with pipes. Reactive mufflers tend to reflect the sound energy back to the source. Dissipative mufflers are usually composed of ducts or chambers which are filled with acoustic absorbing materials. These materials absorb the acoustic energy and transform it into thermal energy.

Reactive mufflers are most useful when the source noise is composed of pure tones at specific, fixed frequencies, and when the fluid to be muffled is a hot, dirty, high-speed gas flow. Reactive mufflers are particularly useful for low frequency applications and for those installations where high temperatures or flammable gasses restrict the use of dissipative materials. Reactive mufflers are often constructed of baffles, reverse flow passages, or multiple tubes. These configurations produce a relatively high pressure drop, causing a back pressure at the exhaust of an engine, thus restricting engine performance. Back pressure produced by passenger car mufflers can range as high as three to seven pounds per square inch at maximum engine power. As a result it is desirable to employ a "straight-through" configuration to effectively eliminate back pressure.

Dissipative mufflers are useful when the source produces noise in a broader frequency band. They are particularly effective at high frequencies, but precautions must be taken if the fluid flow has a high velocity or temperature or if it contains particles or is corrosive. The most simple dissipative muffler is constructed by lining the interior of a duct with sound absorbing material. At high velocity, facing materials such as wire screens or perforated metal sheets are necessary to prevent erosion of the sound absorbing material. Dissipative mufflers produce a relatively low pressure drop with high attenuation at predominately middle and high frequencies. A typical dissipative muffler may be effective above approximately 500 Hertz. The approximate attenuation per linear foot is a function of the acoustical absorption coefficient of the absorbing material, the volume of the duct, as well as the frequency of the sound. Mufflers are generally tuned to attenuate specified frequencies. This tuning is volume dependent. A longer muffler will attenuate lower effective frequencies. The maximum efficiency for a simple dissipative muffler occurs at a frequency at which the width of the duct is between one half and twice the wavelength of the sound.

Mufflers which consist of a combination of the reactive and dissipative types are known in the art in a variety of configurations.

SUMMARY OF THE INVENTION

The present invention provides a muffler having both reactive and dissipative elements. The muffler has multiple dissipative sound absorbing chambers and a reactive annular outer gap. The muffler includes a straight-through flow tube having a constant cross-section and diameter, and creating low backpressure. The flow tube allows a fluid flow, preferably comprising the exhaust gases of an internal combustion engine, to pass entirely through the muffler. The muffler requires no baffles, multiple tubes, or reverse flow sections.

The present invention comprises an annular housing, an inlet to the housing, and outlet from the housing, an elongated flow tube which communicates between the inlet and the outlet, two annular end chambers containing sound absorbing material, an annular resonating chamber between the two end chambers, and a relatively thin annular sleeve containing sound absorbing material, disposed around the flow tube and contained entirely within the resonating chamber. Perforations allow communication between the flow tube and the annular sleeve, between the annular sleeve and the resonating chamber, as well as between the resonating chamber and the end chambers. The total volume of the muffler, length of the muffler, and length of each end chamber may be varied in order to tune the muffler to eliminate specified frequencies of noise.

It is an object of the present invention to effectively attenuate noise over a broad band of frequencies.

It is a further object of the present invention to provide a straight-through flow tube, low backpressure muffler.

It is a further object of the present invention to provide a muffler having both reactive and dissipative elements.

It is a further object of the present invention to provide a muffler configured and tuned to effectively muffle the exhaust noise of an automobile internal combustion engine.

These and other advantages and features will become apparent from the following description and claims in conjunction with the accompanying drawings.

BRIEF DESCRIPTION OF THE DRAWINGS

FIG. 1 is a sectional view of a muffler arranged according to the principles of the present invention;

FIG. 2 is a sectional view along line 2—2 in FIG. 1;

FIG. 3 is an enlarged partial sectional view of one aspect of the present invention;

FIG. 4 is a sectional view of a first alternative embodiment of the present invention;

DETAILED DESCRIPTION OF THE PREFERRED EMBODIMENT

Figure 6:
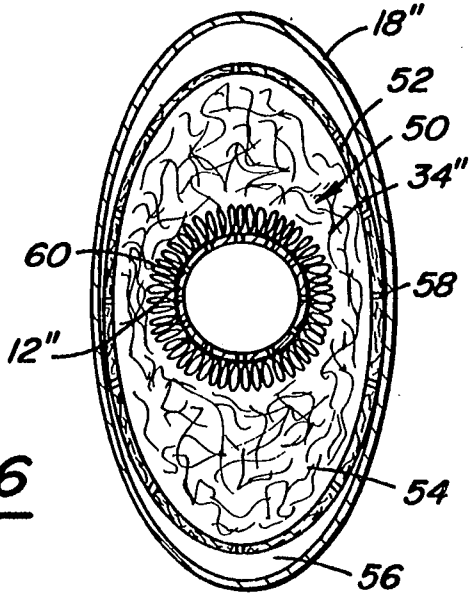
FIG. 6 is a sectional view along line 6—6 in FIG. 5.

In the embodiment of FIGS. 1–3, muffler 10 is connected to an exhaust pipe by a coupling means (not shown). The fluid, normally air and other exhaust gases, flowing through the exhaust pipe carries sound waves generated during the operation of the internal combustion engine. The majority of these sound waves are considered undesirable noise which is to be muffled.

With reference to the drawings, FIG. 1 shows a muffler 10 having a straight-through flow tube 12. Two annular outer end plates 14,16 are mounted to the flow tube 12, and comprise doughnut-shaped disks with no other perforations than the one allowing assembly on the flow tube 12. An outer shell 18 Is mounted about the flow tube 12 and spans the space between the outer end plates 14,16. The outer shell 18 is affixed to the perimeter of the outer end plates 14,16 so as to define a muffling chamber 20 which is imperforate, allowing no gas or sound waves to escape. Two annular inner end plates 22,24 define, in conjunction with outer end plates 14,16, two end chambers 26,28, as well as a central annular resonating chamber 30. Muffling chamber 20 therefore consists of resonating chamber 30 and both end chambers 26,28.

Preferably, an annular sound absorbing sleeve 32 surrounds a portion of the flow tube 12 contained within the resonating chamber 30. The end chambers 26,28 both contain sound absorbing material 34, as does the central annular sleeve 32. This material is preferably fiberglass, and may also be wire mesh, steel wool, basalt wool or similar material. The annular sleeve 32 and the end chambers 26,28 may each be filled with a different type of sound absorbing material 34. The construction material for the flow tube 12, outer end plates 14,16, inner end plates 22,24, outer shell 18 and annular sleeve 32 is preferably a metal, such as stainless steel or aluminized coated or low carbon steel.

The flow tube 12 is preferably a straight round cylinder passing entirely through the muffler 10 and having a constant diameter and cross-section. The flow tube 12 has a smooth and continuous interior surface, with no baffles or flow barriers. The flow tube 12 is formed with perforations 36 around its perimeter to allow the sound waves to communicate with the muffling chamber 20. The flow tube 12 in the preferred embodiment is formed with apertures 36 only along the length which is surrounded by the annular sleeve 32. In addition, the inner end plates 22,24, and inner annular sleeve 32 are formed with apertures 38,40,42, respectively, comprising holes allowing fluid communication through each respective member. In the preferred embodiment, these apertures 36,38,40,42 are formed as louvers 44, rather than through holes, as shown in FIG. 3. Louvers 44 may be formed in various configurations, and the louvers 44 shown in FIG. 3 serve only as an example.

The annular sleeve 32 which surrounds a portion of the flow tube 12 is contained entirely within the resonating chamber 30. The length of the annular sleeve 32 is less than or equal to the length of the resonating chamber 30. The ends of the sleeve 32 do not extend to reach the inner end plates 22,24. This central sound absorbing means 32,34 is preferably formed as a "pinch can" which is constructed of a tube, the ends of which are compressed into contact with the outer surface of the flow tube. The annular sleeve 32 may also be formed of a finely perforated screen.

The sound absorbing means, consisting of the annular sleeve 32 and sound absorbing material 34, operates to reduce pressure pulsations flowing from inside the flow tube 12 into the muffling chamber 20. This annular sleeve sound absorbing means 32,34 acts as a mechanical filter to dampen high pressure spikes. In another embodiment of the present invention, the sound absorbing material 34 and annular sleeve 32 may be eliminated.

The cross-section of the muffler 10 is preferably an oval shape, but may also be round, or even square or rectangular. An oval muffler 10 produces better noise attenuation and causes little shell ringing. A square or rectangular muffler transmits high frequency sound and may resonate, producing a kettle drum or bell-like ringing sound.

A first alternative embodiment of the present invention is shown in FIG. 4, wherein the flow tube 12' is not axially aligned with the centroid of the oval muffling chamber 20' defined by outer shell 18'. This off-center configuration enables the present invention to fit within the volume available in the particular application, usually the undercarriage of an automobile.

Figure 5:
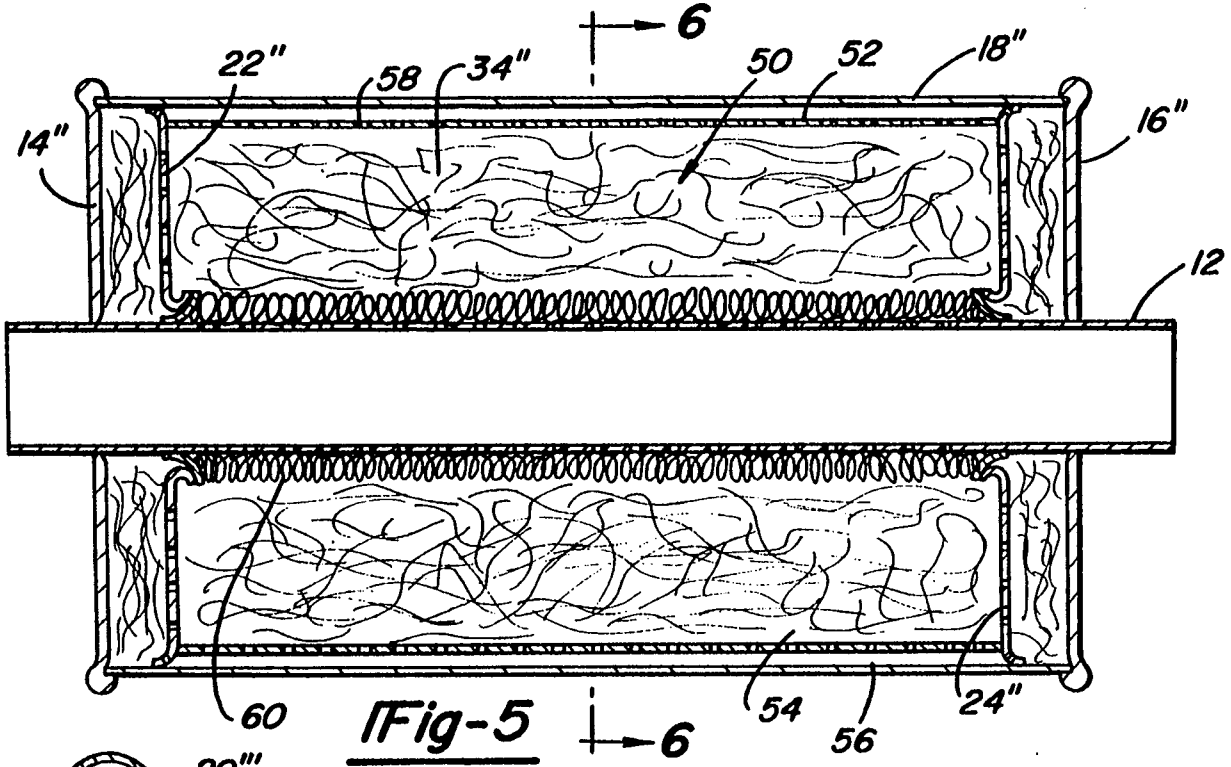
FIG. 5 is a sectional view of a second alternative embodiment of the present invention.

A second alternative embodiment is shown in FIGS. 5 and 6, wherein the central annular sound absorbing means indicated generally at 50 is constructed of an inner shell 52 which surrounds the flow tube 12" intermediate the outer shell 18". The inner shell 52 is welded to and spans the distance between the inner end plates 22",24". The inner shell 52 defines an inner dissipative chamber 54 and an outer annular resonating gap 56. The inner shell 52 is preferably composed of a metal and is formed with perforations 58. The dissipative chamber 54 is filled with sound absorbing material 34". A wire screen 60 may be wrapped around the flow tube 12" between the inner end plates 22,24 to operate as a mechanical filter to reduce air pressure pulsations.

Figure 7:
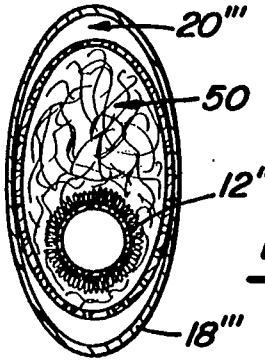
FIG. 7 is a sectional view of a third embodiment of the present invention.

A third alternative embodiment is shown in FIG. 7, which depicts a muffler having the sound absorbing means 50 described as in the second alternative embodiment above, and wherein the flow tube 12''' is not axially aligned with the centroid of the oval muffling chamber 20''' defined by outer shell 18'''.

All embodiments of the present invention may be tuned to eliminate specific ranges of noise frequencies. The tuning process is necessarily empirical, and is based on trial and error. The length of the end chambers 26,28 may be altered to tune the muffler, and further the length of each end chamber 26,28 may be different. In addition, the ratio of the volume of the annular sleeve 32,52 or dissipating chamber 54 to the volume of the resonating chamber 30 or annular gap 56 may be set to tune the muffler. Depending on the desired noise frequencies for attenuation, the volume ratio may range from approximately 10% to 90%. An annular sleeve 32 or "pinch can" as shown in FIGS. 1 and 2 is preferable for a volume ratio on the order of 10% to 50%. An inner shell 52 as shown in FIGS. 5 and 6 is preferable for a volume ratio on the order of 50% to 90%.

All embodiments of the present invention operate in substantially the same manner. In operation, exhaust gas enters the inlet 46 to the flow tube 12 of the muffler 10, and may flow straight though the flow tube 12 and exit from the outlet 48. High pressure pulses of exhaust gas may flow from the flow tube 12 though the sound-absorbing material 34 contained in annular sleeve 32,52 through the perforations 42,58 in the annular sleeve 32,52 and into the resonating chamber 30. Exhaust gas may further flow from resonating chamber 30 into the end chambers 26,28. High pressure pulses are damped by the sound-absorbing chambers 26,28,32,54 as well as by the finite volume enclosed by the outer shell 18 and outer plates 14,16 of the muffling chamber 20. Exhaust gas tends to flow straight through the flow tube 12, and not escape through the perforations 36 on the flow tube 12, because the gas cannot escape the muffler 10 by any other means than the outlet 48.

Acoustic noise carried by exhaust gas is attenuated by absorption and reflection. The sound-absorbing material 34 contained in annular sleeve 32 and the end chambers 26,28 operates to absorb the sound waves, transforming mechanical acoustic energy into thermal energy. The resonating chamber 30 operates to reflect specific frequencies of sound through the flow tube 12, back out the inlet 46 of the muffler 10.

It should be understood that various modifications of the preferred embodiments of the present invention will become apparent to those skilled in the art after a study of the specification, drawings, and the following claims.

We claim:

1. A muffler, comprising:

a tubular member having imperforate inlet and outlet end portions and a perforate central portion arranged along a central longitudinal axis;

an imperforate outer shell;

a first pair of headers spaced longitudinally and extending radially between the imperforate inlet end portion and the outer shell to form a first annular end chamber;

a second pair of headers spaced longitudinally and extending radially between the imperforate outlet end portion and the outer shell to form a second annular end chamber, each said header pair including a perforate header and an imperforate header, said imperforate headers forming opposite longitudinal endwalls of the muffler, said perforate headers being disposed interiorly of the shell and forming an annular chamber around the perforate central portion of said tubular member, and each said annular end chamber between the respective perforate and imperforate headers and radially between the imperforate end portions and imperforate outer shell being substantially filled with sound absorbing material; and a tubular sleeve extending longitudinally between said perforate headers and having a perforate central portion encircling the perforate central portion of said tubular member, said sleeve defining an outer annular resonating chamber between the sleeve and said outer shell and an inner annular sound absorbing chamber around the perforate central portion of said tubular member, said sound absorbing chamber being substantially filled with sound absorbing material.

2. The muffler as set forth in claim 1, wherein said tubular member comprises a cylindrical flow tube having a constant diameter.

3. The muffler as set forth in claim 1, wherein said tubular member comprises a one-piece straight-through flow tube.

4. The muffler as set forth in claim 1, wherein said sound absorbing material is selected from the group consisting of wire mesh, steel wool, basalt wool, and fiberglass batting.

5. The muffler as set forth in claim 1, wherein said muffler has an oval cross-section.

6. The muffler as set forth in claim 1, wherein said outer shell is arranged along a central axis which is generally parallel to and spaced from the longitudinal axis of said tubular member.

7. The muffler as set forth in claim 1, wherein the perforations in said perforate headers and perforate central portion comprise louvers.

8. The muffler as claimed in claim 1 wherein the tubular member is integral and forms a continuous primary through path for passing exhaust gases between the inlet and outlet end portions of the muffler.

9. The muffler as claimed in claim 1 wherein the sound absorbing material in each of said end chambers and said sound absorbing chamber are the same.

10. A muffler, comprising:

a tubular member for passing exhaust gases extending longitudinally between opposite ends and having an imperforate end portion and a perforate central portion;

imperforate first and second end plates mounted to and extending radially from said tubular member;

a cylindrical outer shell mounted to said end plates so as to define a muffling chamber around and between the ends of said tubular member;

a perforate end plate disposed interiorly of said shell between said imperforate end plates, said perforate end plate being connected to said tubular member and to said outer shell and extending generally radially therebetween so as to define an annular end chamber between said perforate end plate and said first end plate and providing the sole means for communicating exhaust gases from the perforate central portion of said tubular member into said annular end chamber, sound absorbing material disposed in and substantially filling the annular end chamber defined between the perforate and imperforate end plates and radially between the shell and the imperforate end portion of the tubular member; and sound absorbing means completely surrounding and engaging the perforate central portion of said tubular member, said sound-absorbing means substantially filling an annulus formed between the tubular member and the inner wall of said outer sleeve except for a small annular air chamber formed between the inner wall of said outer shell and the sound absorbing means.

11. The muffler as set forth in claim 10, wherein said tubular member comprises a cylindrical flow tube having a constant diameter.

12. The muffler as set forth in claim 10, wherein said tubular member comprises a straight-through flow tube.

13. The muffler as set forth in claim 10, wherein said sound absorbing material is selected from the group consisting of wire mesh, steel wool, basalt wool, and fiberglass batting.

14. The muffler as set forth in claim 10, wherein said muffler has an oval cross-section.

15. The muffler as set forth in claim 10, wherein said outer shell is arranged along a central axis which is generally parallel to and spaced from the longitudinal axis of said tubular member.

16. The muffler as set forth in claim 10, wherein the perforations in said perforate headers and perforate central portion comprise louvers.

17. The muffler as set forth in claim 10 wherein the tubular member, the outer shell, and the end plates are formed of stainless steel.

18. The muffler as set forth in claim 10 wherein the tubular member, the outer shell, and the end plates are formed of aluminized coated or carbon steel.

19. The muffler as claimed in claim 10, further comprising said tubular member having a second imperforate end portion inwardly of said shell and between said second end plate and said perforate end plate, a second perforate end plate extending radially between said tubular member and said outer shell whereby to form with said second end plate a second annular end chamber around said second imperforate end portion, and sound absorbing material disposed in and substantially filling said second annular end chamber between the shell and the second imperforate end portion of the tubular member, said perforate second end plate for communicating exhaust gases from the central portion of said tubular member into said second annular end chamber.

20. A muffler for silencing exhaust gases, comprising:

a straight-through exhaust gas flow tube having imperforate inlet and outlet end portions and a perforate central portion located between said end portions;

an outer shell having a pair of imperforate endwalls extending radially between said flow tube and said outer shell;

an inner sound absorbing chamber comprising sound absorbing material surrounding the perforate central portion of said flow tube;

an outer resonating chamber enclosing said inner sound absorbing chamber;

a perforate header extending radially between said flow tube and said outer shell, said header and one of said end walls forming an annular end chamber around one of said imperforate end portions;

a sound absorbing material extending between the header and said one end wall and radially between said shell and said one perforate end portion and substantially filling said annular end chamber, said perforate header being provided with a plurality of apertures to pass exhaust gases from said inner sound absorbing chamber into said annular end chamber.

21. The muffler as set forth in claim 20, wherein said flow tube comprises a cylinder of constant diameter and cross-section.

22. The muffler as set forth in claim 20, wherein said sound absorbing material is selected from the group consisting of wire mesh, steel wool, basalt wool, and fiberglass batting.

23. The muffler as set forth in claim 20, wherein said muffler has an oval cross-section.

24. The muffler as set forth in claim 20 wherein said outer shell is arranged along a central axis which is generally parallel to and spaced from the longitudinal axis of said tubular member.

25. The muffler as set forth in claim 20, wherein the perforations in said perforate headers and perforate central portion comprise louvers.

26. The muffler as set forth in claim 20, wherein said muffler comprises a wire screen material wrapped around said flow tube between said inner end plates.

27. The muffler as set forth in claim 20, said outer resonating chamber comprises a sleeve encircling said inner sound absorbing chamber, said sleeve having one end connected to said perforate header and having a plurality of apertures allowing communication between said annular end chamber and said outer resonating chamber.

28. A muffler for silencing exhaust gases, comprising a main straight-through sound conducting tube for passing exhaust gases between an inlet and an outlet end of the tube, a shell having spaced end walls and forming a muffling chamber around said tube, said tube including a first and second imperforate end portion adjacent, respectively, to said inlet end and to said outlet end and a perforate central portion between said imperforate end portions for communicating exhaust gases into said muffling chamber, first pervious sound absorbing material encircling said perforate central portion, a header extending between the tube and the shell for defining an annular end chamber encircling one said imperforate end portion, passage means in said header for communicating sound waves from said sound conducting tube into said annular end chamber, and second pervious sound absorbing material, extending longitudinally between one end wall of the shell and the header and radially between the shell and the one imperforate end portion of the sound conducting tube and substantially filling said annular end chamber, for silencing said sound waves.

* * * * *